US005394663A

United States Patent [19]

Jackson

[11] Patent Number: 5,394,663

[45] Date of Patent: Mar. 7, 1995

[54] PIPE FLASHING VENT

[75] Inventor: James Jackson, Raeford, N.C.

[73] Assignee: Man-U-Co, Inc., Raeford, N.C.

[21] Appl. No.: 74,208

[22] Filed: Jun. 9, 1993

[51] Int. Cl.[6] ..... F04B 7/18

[52] U.S. Cl. ..... 52/199; 52/198; 285/43; 454/362; 454/366

[58] Field of Search ..... 52/198, 199; 285/43; 454/358, 359, 361, 362, 366, 367

[56] References Cited

U.S. PATENT DOCUMENTS

| | | | |
|---|---|---|---|
| 2,300,842 | 11/1942 | Leslie . | |
| 2,363,879 | 11/1944 | Leslie | 454/366 |
| 2,741,972 | 4/1956 | Pryne | 454/366 X |
| 3,083,633 | 4/1963 | Hochberg | 454/366 |
| 3,181,451 | 5/1965 | Hess | 454/359 X |
| 3,285,155 | 11/1966 | Maltenfort | 454/359 |
| 3,521,414 | 7/1970 | Malissa . | |
| 3,579,930 | 5/1971 | Murphy . | |
| 3,742,659 | 7/1973 | Drew | 52/199 X |
| 3,895,467 | 7/1975 | Clement . | |
| 4,102,090 | 7/1978 | Anguish . | |
| 4,386,488 | 6/1983 | Gibbs | 52/199 |
| 4,442,643 | 4/1984 | Stadheim . | |
| 4,480,534 | 11/1984 | Sloan . | |
| 4,524,262 | 6/1985 | Meyer . | |
| 4,526,407 | 7/1985 | Kifer . | |
| 4,768,812 | 9/1988 | Katz . | |
| 4,803,816 | 2/1989 | Klober . | |
| 4,890,546 | 1/1990 | Venge . | |
| 4,899,505 | 2/1990 | Williamson et al. . | |
| 5,053,266 | 10/1991 | Hesketh et al. | 52/199 X |

FOREIGN PATENT DOCUMENTS

| | | | |
|---|---|---|---|
| 2645629 | 10/1990 | France | 454/361 |
| 2348214 | 4/1975 | Germany | 454/358 |
| 3-129054 | 6/1991 | Japan | 52/199 |

OTHER PUBLICATIONS

Grainger Catalog p. 2491 undated.

Popular Mechanics p. 72 dated Feb. 1993.

*Primary Examiner*—Carl D. Friedman

*Assistant Examiner*—Kevin D. Wilkens

*Attorney, Agent, or Firm*—Rhodes, Coats & Bennett

[57] ABSTRACT

A vented building includes a structure with a roof, the roof including a sloping support surface having an opening therein and roofing materials on the support surface. A housing with peripheral walls surrounded by and connected to a flashing is mounted on and in alignment with the opening in the support surface such that the flashing is supported by the support surface and covered by roofing material. At least one opening in the housing is spaced above the flashing, and a gasket is located within the housing and sealing the inside of the housing. A pipe extends from within the structure to the gasket with the gasket sealingly receiving the pipe. Thus, the pipe is provided with a vent through the opening in the housing to vent the pipe to the exterior of the building through the building's roof while preventing the ingress of precipitation to the interior of the building.

22 Claims, 3 Drawing Sheets

PIPE FLASHING VENT

BACKGROUND OF THE INVENTION

The present invention relates to improvements in connections for vent pipes in roofs.

Typically, vent pipes in roofs for residential buildings are provided to permit the escape of gas-phase materials. Indeed, most residential building codes require that building's sewer connections be provided with vents so that obnoxious and potentially hazardous fumes are not released into the household. These connections are typically achieved by extending a pipe to the roof that opens upwardly to the sky, with a seal around the outside of the pipe to prevent rainwater or other precipitation from entering the building from the outside of the pipe. However, no provision is made to prevent rainwater from entering the pipe itself, the assumption being that since the pipe is connected to the sewage system, little harm is done in permitting leakage into the pipe. A typical installation and flashing of this type is shown in U.S. Pat. No. 4,526,407 to Kifer.

However, vent connections of this type have numerous drawbacks.

As an example, a homeowner in Pottsville, Pa. in a letter to "Home and Shop Journal, Homeowner's Clinic" in the February 1993 *Popular Mechanics*, page 72 reported having a problem of water entering the dwelling space during a heavy rain. The problem was diagnosed as a break or blockage inside the vent pipe. The entry of the water into the vent-stack pipe posed a serious problem.

In addition, water entering the stack pipe is typically rainwater, requiring no sewage treatment. However, since it is directed to the sewage system the added rainwater adds to sewage treatment load. This is undesirable, particularly since many communities are faced with a lack of sewage capacity. It has been estimated that at least in some parts of the country, as many as 20 gallons a year is added to the sewage load from rainwater entering one unprotected stack pipe.

Finally, the conventional stack pipes are unattractive. Accordingly, it is the usual practice to install vent pipes on the rear side of a roof, so that the appearance of a building from the front is not deteriorated by the presence of the stack pipe vent. However, if the fixture requiring venting is in the front of the house, this means added expense in the form of both labor and materials to run the stack pipes to the rear of the buildings.

Accordingly, there remains a need in the art for an improved roof vent flashing which will prevent rainwater and debris from entering the pipe and is aesthetically acceptable to be placed on the front of a building.

SUMMARY OF THE INVENTION

The present invention fulfills this need in the art by providing a pipe flashing vent for venting an interior pipe to the exterior of a building through the building's roof while preventing the ingress of precipitation to the interior of the building. A housing includes peripheral walls surrounded by and connected to a flashing for mounting on the roof such that the flashing can be covered by roofing material. At least one opening in the housing is spaced above the flashing, and a gasket is located within the housing and sealing the inside of the housing. The gasket has an opening adapted to sealingly receive a pipe, so that the flashing may be installed on a roof and covered with roofing materials, and an interior pipe may be sealingly inserted in the gasket and thereby provided with a vent for venting the pipe to the exterior of the building through the building's roof while preventing the ingress of precipitation to the interior of the building.

In a preferred embodiment the housing includes a portion recessed below the flashing and the gasket is located in the recessed portion. In this embodiment the gasket may be sealed to the recessed portion in a plane at an acute angle to the flashing.

Preferably, the peripheral walls include a plurality of vent holes to permit air currents to pass through the housing.

Also preferably, the peripheral walls include a pair of side walls, and the side walls have a height and a length and the length is at least three times the height. The side walls may diverge outwardly away from the flashing.

In one embodiment the housing has a removable cap. The cap may have a sidewall affixed thereto which cooperates with the peripheral walls to complete the housing. Preferably, the sidewall affixed to the cap is on the lower side of the installed housing. The cap may have inwardly facing grooves along its edges and the peripheral walls may have outwardly turned upper edges to permit the cap to be mounted on the peripheral walls by a sliding motion in which the outwardly turned upper edges of the peripheral walls engage associated grooves on the cap. The cap may include bendable tabs outward of the affixed sidewall to permit the cap to be secured in place by bending the tabs over the outwardly turned edges of the adjacent peripheral walls when the cap is in place.

Desirably, the housing includes a sloping upper peripheral wall to deflect water which may run down the roof on which the pipe flashing vent is installed. Preferably, that wall does not have any openings.

In another aspect, the invention provides a vented building including a structure with a roof, the roof including a sloping support surface having an opening therein and roofing materials on the support surface. A housing including peripheral walls is surrounded by and connected to a flashing and mounted on and in alignment with the opening in the support surface such that the flashing is supported by the support surface and covered by roofing material. At least one opening in the housing is spaced above the flashing. A gasket located within the housing seals the inside of the housing, and a pipe extends from within the structure to the gasket, the gasket sealingly receiving the pipe. Thus, the pipe is provided with a vent through the opening in the housing to vent the pipe to the exterior of the building through the building's roof while preventing the ingress of precipitation to the interior of the building.

The pipe may extend to the gasket from any suitable fixture, such as a sewer stack vent, a bathroom exhaust fan, a range hood fan, or other vent.

In yet another aspect, the invention provides a method of installing a vent for an interior pipe to the exterior of a building through the building's roof while preventing the ingress of precipitation to the interior of the building. The method includes mounting a housing including peripheral 7alls surrounded by and connected to a flashing on the roof in alignment with an opening in the roof, the housing including at least one opening spaced above the flashing and a gasket located within the housing, sealing the inside of the housing and having an opening adapted to sealingly receive a pipe. The method proceeds by covering the flashing with roofing material, and inserting an end of a pipe into sealing relationship with the opening in the gasket, the other end of the pipe extending into the building. Thus, the pipe is vented to the exterior of the building through the building's roof while preventing the ingress of precipitation to the interior of the building.

If the housing includes a portion recessed below the flashing, the inserting step may include providing a pipe to be inserted in the gasket that is too short to extend above the roof. The inserting step may include sealing the gasket to the pipe at sealing locations in a plane at an acute angle to the flashing.

The mounting step preferably includes securing a removable cap to the housing, such as securing a cap that has a sidewall affixed thereto which cooperates with the peripheral walls to complete the housing. If the cap has inwardly turned edges to define grooves and the peripheral walls have outwardly turned upper edges, the mounting step may include sliding the cap on the peripheral walls while the outwardly turned upper edges of the peripheral walls engage associated grooves on the cap. If the cap has bendable tabs outward of the affixed sidewall, the method may include securing the cap in place by bending the tabs over the outwardly turned edges of the adjacent peripheral walls.

Preferably, the method includes connecting the other end of the pipe to a suitable fixture, such as a sewer stack vent, a bathroom exhaust fan, a range hood fan, or other vent.

The pipe flashing vent may also include a rigid pipe located in the gasket and a damper mounted on the rigid pipe to prevent the ingress of air when the damper is closed.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
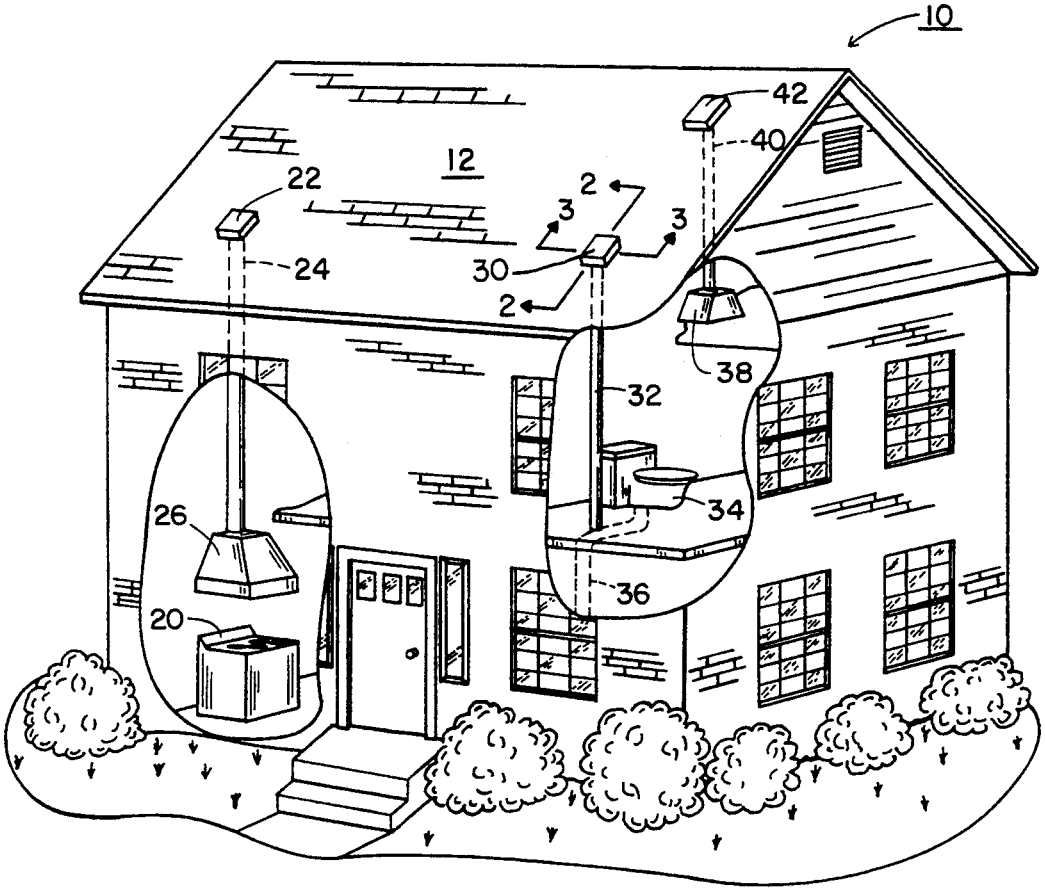
FIG. 1 is a perspective view of a residential building equipped with four installations of an embodiment of the present invention, with portions of the building removed to show internal connections.

Referring now to FIG. 1, there can be seen a typical residence or other building 10 having a pitched, shingled roof 12. Portions of the outer walls and roof of the building 10 shown in FIG. 10 have been broken away to show interior components. A stove 20 has a range hood fan 26 connected through piping 24 to a roof flashing vent 22 according to the invention.

FIG. 1 also depicts a toilet 34 connected to a sewage drain line 36. A sewer vent pipe 32 extends upwardly from the drain 36 to an additional one of the roof flashing vents 30. Finally, a bathroom fan 38 is connected through outlet ducting 40 to an additional one of the roof flashing vents 42.

The three vents shown in FIG. 1 are intended to be merely exemplary of common uses, but other pipes to be vented could also be connected. As will be appreciated, the roof flashing vents shown in FIG. 1 are mounted on the front side of the roof 12, but the could just as well be mounted on the rear, if that is more convenient. Additionally, to the extend that good building practice permits, various ones of the ducts 24, 32 and 40 could be joined inside building 10 and extend to a reduced number of roof flashing vents.

Figure 2:
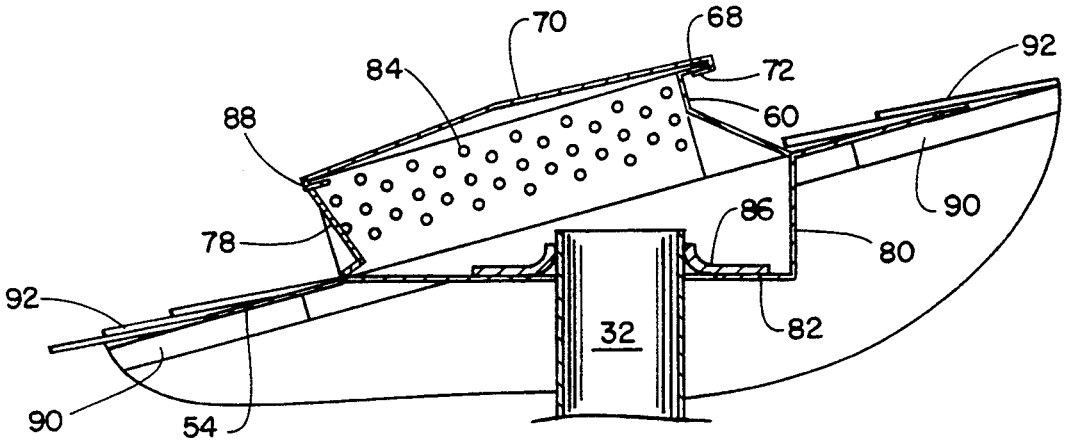
FIG. 2 is a is an enlarged sectional view of the embodiment of FIG. 1 taken along lines 2—2 looking in the direction of the arrows.

Referring now to FIG. 2, a sectional view along lines 2—2 of FIG. 1 in the direction of the arrows, details of the structure of roof flashing vent 30 can be seen. The other roof flashing vents 22, 42 are identical. The vent includes a flashing 54 extending outwardly of a housing 52. The flashing 54 rests on a plywood or other supporting surface 90 of the roof and is overlain by roofing material such as shingles 92, resulting in the housing 52 upstanding slightly from the shingles. However, the housing 52 is made with short sidewalls 56, 58, 60 and 78 so as to provide a low-profile projection from the roof. This permits it to blend visually into the roof, so as to provide an aesthetically acceptable appearance. In addition, if desired, the cap 70 of the housing may be provided in a color or finish to match the shingles 92. The cap 70 could be adapted to receive at least a portion of a shingle during construction so as to be visually quite similar to the roof surface.

Figure 3:
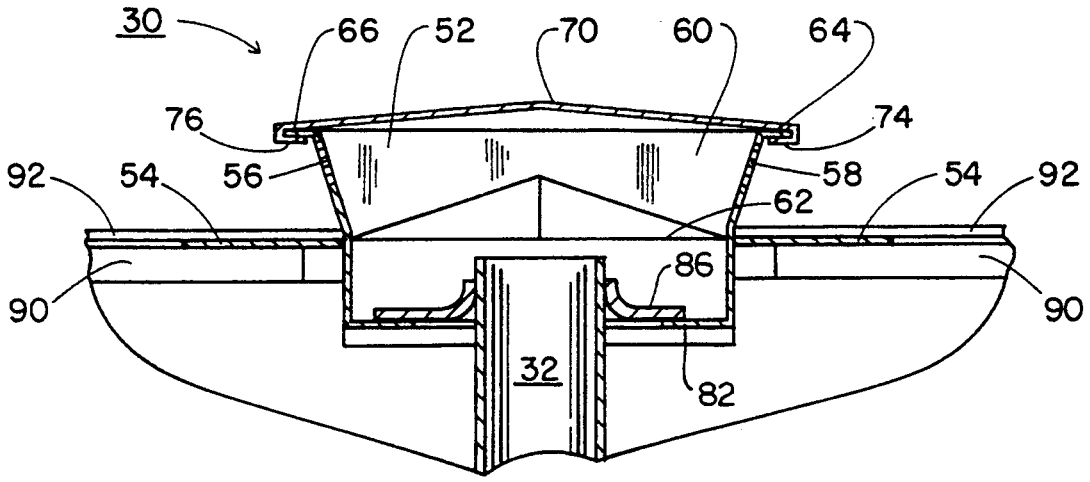
FIG. 3 is a is an enlarged sectional view of the embodiment of FIG. 1 taken along lines 3—3 looking in the direction of the arrows.

As can be see in FIG. 3, the left and right ones of the peripheral walls 56 and 58 are slanted about 10° out from a line perpendicular with the flashing 54. The peripheral walls 56, 58 and 78 are provided with openings 84 in upper portions thereof. Desirably, the openings are numerous to provide for considerable movement of air through the housing 52. However, it is desired to keep the openings relatively small to prevent leaves and other debris from entering the housing.

The upper wall 60 of the peripheral walls is provided with a sloping addition 62 also called "cricket," to assure that rainwater or other precipitation traveling down the shingles 92 from the right as seen in FIG. 2 are deflected away from the housing. And, wall 60 is free of openings to prevent the entry of water that runs down the sloping roof.

The openings 84 are provided in the upper portions only of the walls 56, 58 and 78 in order to keep water flowing down the roof from entering the housing.

The housing 52 has a recess 80, typically provided with a peripheral shelf or rim 82 at an angle to the flashing 54. The angle can vary, but desirably is selected to compensate for the pitch of the roof 12, so as to provide a relatively horizontal plane in which a gasket 86 rests. The gasket 86 is sealed to the housing 52 such as by adhesive or heat sealing to the shelf 82 or to the side walls of the recess 80.

The peripheral walls 56, 58 and 60 are provided with outwardly turned upper edges 66, 68, 64, respectively. A cap 70 is provided of the size to extend beyond the edges of the outwardly turned upper edges. The edges of the cap are turned under as at 76, 72, 74 to form grooves which interengage with the outwardly turned edges. The lower edge of the cap 70 has depending from it the lower one of the peripheral walls 78. Thus, the cap may be installed by lowering it with the wall 78 adjacent to the inner side of wall 60, engaging the outwardly turned edge 66 with the groove formed by the inwardly turned edge 76 and the outwardly turned edge 64 with the groove formed by the inwardly turned edge 74 and sliding the cap downward until the position shown in FIG. 2 is reached. At that time, the outwardly turned edge 68 of wall 60 will be engaged with the inwardly turned edge 72 of the cap 70.

Desirably, the cap 70 is also provided with tabs 88 on both ends of the side wall 78. The tabs 88 may be turned under to cover the outwardly turned edges and grooves on the walls 56 and 58 to lock the cap in place.

Most of the gasket 86 is positioned below the actual line of the roof, as defined by the supporting plywood 90. The pipe to be vented 32 may be inserted in sealing relationship to the inner side of the gasket 86 and extend only enough into the gasket 86 to be held in place. There is no need to extend the pipe further, and, in fact, the pipe must not extend so far as to interfere with the placement of the cap 70 and its forward wall 78.

Figure 4:
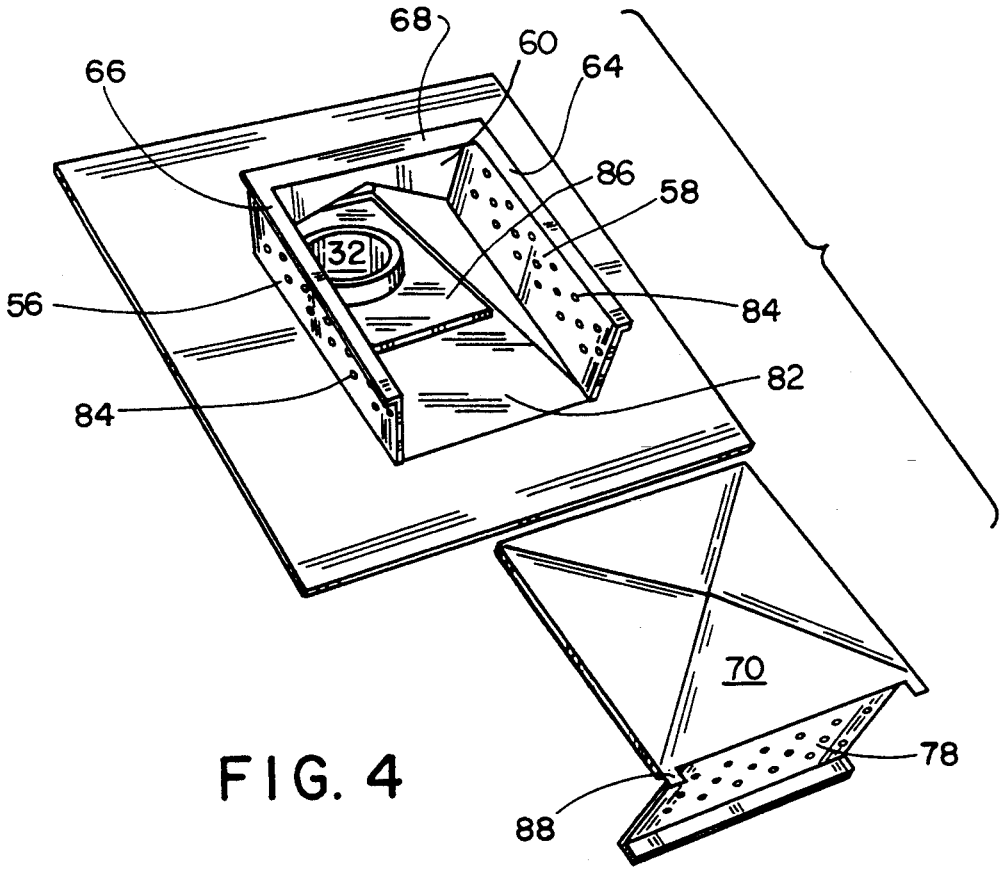
FIG. 4 is an enlarged perspective view of a disassembled unit of the preferred embodiment.

The roof flashing vent, separate from the roof, is shown in a perspective, disassembled form in FIG. 4 to permit further appreciation of the relationship of the components as described herein above.

The materials of the roof flashing vent are not critical. In one embodiment the housing and flashing are made of sheet metal, formed and riveted together as needed to form the depicted configuration. The gasket is preferably of rubber or some other pliable, water-impervious material. The flashing, housing and cap may be formed of steel, galvanized steel, aluminum or plastic. Other materials suitable to withstand the weather may also be used.

Installation of the roof flashing vent is simple. During construction, the plywood 90 is applied to the roof, with a hole in the plywood 90 of a size to receive the recess 80. The roof flashing vent 30 is then mounted, with the recess extending through the hole and the wall 60 on the uphill side. The flashing 54 extends outward over the plywood. Then, the shingles 92 or other roofing material can be applied to the roof, covering the flashing 54. The plumbing contractor can run his vent pipe to the flashing and interfit the end of the pipe with the gasket 86, followed by applying the cap 70 in the manner described above.

Since the roof flashing vent of the present invention is aesthetically acceptable, it can be installed on the front of the house, saving extensive runs of piping to a rear surface. Also, since the actual opening of the pipe is protected from incoming rain, very little moisture will enter the stack pipe. This prevents damage to the interior of the building 10 should there be a leak in the vent stack pipe and also relieves unnecessary burdens on the sewage system.

Figure 5:
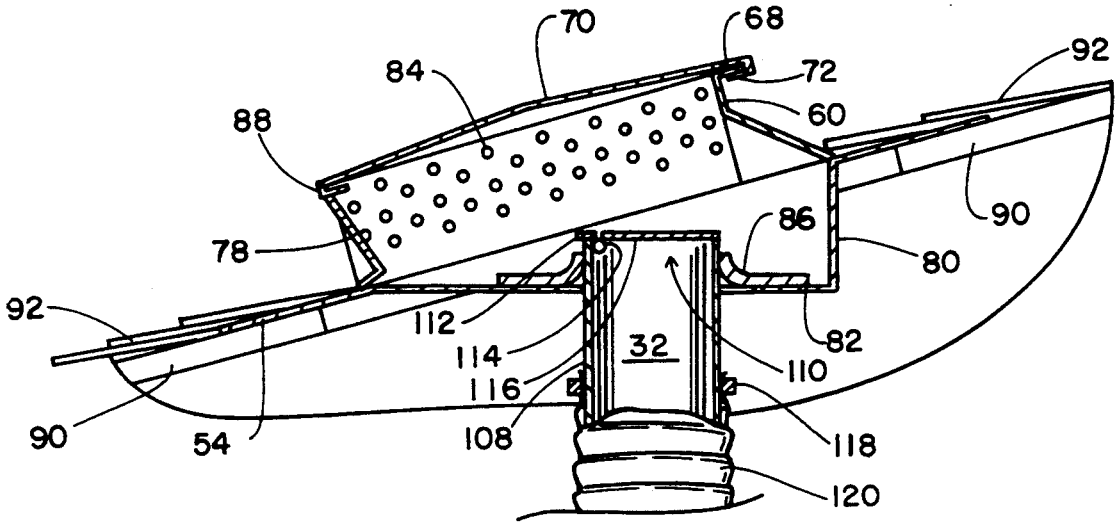
FIG. 5 is a view similar to the view of FIG. 2 of an alternate embodiment.

FIG. 5 illustrates an alternate embodiment, especially designed for bathroom fan vents, in that a damper 110 is added to prevent the ingress of air when the damper is closed. The damper 110 includes a portion 112 affixed to a rigid pipe 108. A hinge 114 connects the portion 112 to a butterfly portion 116. Thus, when the air pressure under the butterfly portion is greater than that above such as when the exhaust fan is on, the valve 116 is lifted to let the air escape. The pipe 108 is provided as part of the apparatus, with the gasket 84 surrounding it. Bathroom fans are usually connected to the vent pipe by a flexible, corrugated piping 120. In this embodiment, the piping 120 is clamped onto the pipe 108 with a conventional clamp 118.

Those of ordinary skill in the art will perceive various modifications which can be made to the invention as specifically described, and those are deemed to be within the scope of this invention. It is especially contemplated that the angle between the flashing 54 and the shelf 82 may be other than as depicted in the drawings, to permit the selection of an appopriate unit for the roof pitch involved.

What is claimed is:

1. A pipe flashing vent for venting an interior pipe to the exterior of a building through the building's roof while preventing the ingress of precipitation to the interior of the building comprising a housing including peripheral walls surrounded by and connected to a flashing for mounting on the roof such that the flashing can be covered by roof material, at least one opening in said housing spaced above said flashing, and a gasket completely located within said housing and sealing the inside of said housing, said gasket being provided with an opening which is adapted to sealingly receive a pipe, said housing including a portion recessed below said flashing and said gasket located in said recessed portion whereby the flashing may be installed on a roof and covered with roofing materials, and an interior pipe may be sealingly inserted in said gasket and thereby provided with a vent for venting the pipe to the exterior of the building through the building's roof while preventing the ingress of precipitation to the interior of the building.

2. A pipe flashing vent as claimed in claim 1 wherein said recessed portion of said housing lies at an acute angle to said flashing and said gasket is sealed to said recessed portion and is thereby in a plane at an acute angle to said flashing.

3. A pipe flashing vent as claimed in claim 1 Wherein said peripheral walls include a plurality of vent holes to permit air currents to pass through said housing.

4. A pipe flashing vent as claimed in claim 1 wherein said housing includes a sloping upper peripheral wall to deflect water which may run down the roof on which the pipe flashing vent is installed.

5. A pipe flashing vent as claimed in claim 4 wherein said upper peripheral wall does not have any openings.

6. A pipe flashing vent as claimed in claim 1 further comprising a rigid pipe extending through said opening in said gasket and a damper mounted on said rigid pipe to prevent the ingress of air when the damper is closed.

7. A pipe flashing vent for venting an interior pipe to the exterior of a building through the building's roof while preventing the ingress of precipitation to the interior of the building comprising a housing including peripheral walls surrounded by and connected to a flashing for mounting on the roof such that the flashing can be covered by roofing material, said peripheral walls including a pair of side walls, said side walls having a height and a length and the length being at least three times the height, at least one opening in said housing spaced above said flashing, and a gasket completely located within said housing and sealing the inside of said housing, said gasket being provided with an opening which is adapted to sealingly receive a pipe, said housing including a portion recessed below said flashing and said gasket located in said recessed portion whereby the flashing may be installed on a roof and covered with roofing materials, and an interior pipe may be sealingly inserted in said gasket and thereby provided with a vent for venting the pipe to the exterior of the building through the building's roof while preventing the ingress of precipitation to the interior of the building.

8. A pipe flashing vent for venting an interior pipe to the exterior of a building through the building's roof while preventing the ingress of precipitation to the interior of the building comprising a housing including peripheral walls surrounded by and connected to a flashing for mounting on the roof such that the flashing can be covered by roofing material, said peripheral walls including a pair of side walls and said side walls diverging outwardly away from said flashing, at least one opening in said housing spaced above said flashing, and a gasket completely located within said housing and sealing the inside of said housing, said gasket being provided with an opening which is adapted to sealingly receive a pipe, said housing including a portion recessed below said flashing and said gasket located in said recessed portion whereby the flashing may be installed on a roof and covered with roofing materials, and an interior pipe may be sealingly inserted in said gasket and thereby provided with a vent for venting the pipe to the exterior of the building through the building's roof while preventing the ingress of precipitation to the interior of the building.

9. A pipe flashing vent for venting an interior pipe to the exterior of a building through the building's roof while preventing the ingress of precipitation to the interior of the building comprising a housing including peripheral walls surrounded by and connected to a flashing for mounting on the roof such that the flashing can be covered by roofing material, a removable cap for said housing, said cap having a sidewall affixed thereto which cooperates with said peripheral walls to complete said housing, said affixed sidewall located on said cap to be on a lower side of the installed housing, at least one opening in said housing spaced above said flashing, and a gasket completely located within said housing and sealing the inside of said housing, said gasket being provided with an opening which is adapted to sealingly receive a pipe, said housing including a portion recessed below said flashing and said gasket located in said recessed portion whereby the flashing may be installed on a roof and covered with roofing material, and an interior pipe may be sealingly inserted in said gasket and thereby provided with a vent for venting the pipe to the exterior of the building through the building's roof while preventing the ingress of precipitation to the interior of the building.

10. A pipe flashing vent for venting an interior pipe to the exterior of a building through the building's roof while preventing the ingress of precipitation to the interior of the building comprising a housing including peripheral walls surrounded by and connected to a flashing for mounting on the roof such that the flashing can be covered by roofing material, at least one opening in said housing spaced above said flashing, and a gasket completely located within said housing and sealing the inside of said housing, said gasket being provided with an opening which is adapted to sealingly receive a pipe, said housing having a removable cap that has a sidewall affixed thereto which together with said peripheral walls completes said housing, whereby the flashing may be installed on a roof and covered with roofing materials, and an interior pipe may be sealingly inserted in said gasket and thereby provided with a vent for venting the pipe to the exterior of the building through the building's roof while preventing the ingress of precipitation to the interior of the building, wherein said cap has inwardly facing grooves along cap edges and said peripheral walls have outwardly turned upper edges to permit said cap to be mounted on said peripheral walls by a sliding motion in which said outwardly turned upper edges of said peripheral walls engage associated grooves on the cap.

11. A pipe flashing vent as claimed in claim 10 wherein said cap includes bendable tabs outward of said affixed sidewall to permit said cap to be secured in place by bending said tabs over said outwardly turned edges of the adjacent peripheral walls when said cap is in place.

12. A pipe flashing vent for venting an interior pipe to the exterior of a building through the building's roof while preventing the ingress of precipitation to the interior of the building comprising a housing surrounded by and connected to a flashing for mounting on the roof such that the flashing can be covered by roofing material, said housing including a. peripheral walls including a pair of side walls, said side walls having a height and a length and the length being at least three times the height and slanting outwardly away from said housing, said peripheral walls having a plurality of vent holes spaced above said flashing to permit air currents to pass through said housing, said peripheral walls having outwardly turned upper edges, b. a removable cap having 1. a sidewall affixed thereto which together with said peripheral walls completes said housing,
2. inwardly facing grooves along cap edges permitting said cap to be mounted on said peripheral walls by a sliding motion in which said outwardly turned upper edges of said peripheral walls engage associated grooves on the cap and
3. bendable tabs outward of said affixed sidewall to permit said cap to be secured in place by bending said tabs over said outwardly turned edges of the adjacent peripheral walls when said cap is in place, c. an upper one of said peripheral walls having a slope to deflect water which may run down the roof on which the pipe flashing vent is installed and being free of openings, d. a portion recessed below said flashing and at an acute angle to said flashing, e. a gasket located in said recessed portion of said housing and sealed to the inside of said recessed portion and thereby in a sealing plane at an acute angle to said flashing, said gasket being provided with an opening adapted to sealingly receive a pipe, whereby the flashing may be installed on a roof and covered with roofing materials, and an interior pipe may be sealingly inserted in said gasket and thereby provided with a vent for venting the pipe to the exterior of the building through the building's roof while preventing the ingress of precipitation to the interior of the building.

13. A method of installing a vent for an interior pipe to the exterior of a building through the building's roof while preventing the ingress of precipitation into the interior of the building comprising mounting a housing including peripheral walls surrounded by and connected to a flashing on the roof in alignment with an opening in the roof, the housing including a portion recessed below the flashing and at least one opening spaced above the flashing and a gasket located within the housing and sealing the inside of the housing, the gasket having an opening adapted to sealingly receive a pipe, covering the flashing with roofing material, and inserting an end of a pipe into sealing relationship with the opening in the gasket to a distance that does not extend above the roof with the other end of the pipe extending into the building, thereby venting the pipe to the exterior of the building through the building's roof while preventing the ingress of precipitation to the interior of the building.

14. An installation method as claimed in claim 13 wherein said recessed portion of said housing is at an acute angle to said flashing, and said inserting step comprises sealing the gasket to the pipe and said recessed portion, which is thereby in a sealing plane at an acute angle to the flashing.

15. An installation method as claimed in claim 13 wherein said mounting step includes securing a removable cap to the housing.

16. An installation method as claimed in claim 15 wherein said mounting step includes securing to the housing a removable cap that has a sidewall affixed thereto which cooperates with the peripheral walls to complete the housing.

17. An installation method as claimed in claim 13 further comprising connecting the other end of the pipe to a sewer stack vent.

18. An installation method as claimed in claim 13 further comprising connecting the other end of the pipe to a bathroom exhaust fan.

19. An installation method as claimed in claim 13 further comprising connecting the other end of the pipe to a range hood fan.

20. A method of installing a vent for an interior pipe to the exterior of a building through the building's roof while preventing the ingress of precipitation to the interior of the building comprising mounting a housing including peripheral walls surrounded by and connected to a flashing on the roof in alignment with an opening in the roof, the housing including at least one opening spaced above the flashing and a gasket located within the housing and sealing the inside of the housing, the gasket having an opening adapted to sealingly receive a pipe, including securing to the housing a removable cap that has a sidewall affixed thereto which together with the peripheral walls completes the housing and that has inwardly facing grooves along its edges and peripheral walls that have outwardly turned upper edges including sliding the cap on the peripheral walls while the outwardly turned upper edges of the peripheral walls engage associated grooves on the cap, covering the flashing with roofing material, and inserting an end of a pipe into sealing relationship with the opening in the gasket with the other end of the pipe extending into the building, thereby venting the pipe to the exterior of the building through the building's roof while preventing the ingress of precipitation to the interior of the building.

21. An installation method as claimed in claim 20 in which the securing step includes securing a cap that has bendable tabs outward of the affixed sidewall and further comprising securing the cap in place by bending the tabs over the outwardly turned edges of the adjacent peripheral walls.

22. A method of installing a vent for an interior pipe to the exterior of a building through the building's roof while preventing the ingress of precipitation to the interior of the building comprising mounting a housing surrounded by and connected to a flashing on the roof in alignment with an opening in the roof with the flashing over and supported by a portion of the roof, the housing including peripheral walls that have outwardly turned upper edges, a portion recessed below and at an acute angle to the flashing, at least one opening spaced above the flashing and a gasket located within the recessed portion and thereby at the acute angle to the flashing and sealing the inside of the recessed portion, the gasket having an opening adapted to sealingly receive a pipe, securing to the housing a removable cap that has a sidewall affixed thereto, inwardly facing grooves along its edges and bendable tabs outward of the affixed sidewall by sliding the cap on the peripheral walls while the outwardly turned upper edges of the peripheral walls engage associated grooves on the cap and securing the cap in place by bending the tabs over the outwardly turned edges of the adjacent peripheral walls, covering the flashing with roofing material, and inserting an end of a pipe that it too short to extend above the roof into sealing relationship with the opening in the gasket at sealing locations in a sealing plane at the acute angle to the flashing, the other end of the pipe extending into the building, thereby venting the pipe to the exterior of the building through the building's roof while preventing the ingress of precipitation to the interior of the building.

* * * * *